US009169745B2

(12) United States Patent
Oh et al.

(10) Patent No.: US 9,169,745 B2
(45) Date of Patent: Oct. 27, 2015

(54) ENGINE HAVING CONTINUOUSLY VARIABLE VALVE TIMING MECHANISM

(71) Applicants: Hyundai Motor Company, Seoul (KR); Kia Motors Corporation, Seoul (KR)

(72) Inventors: Young Kyu Oh, Whasung-Si (KR); Chulho Yu, Whasung-Si (KR); Dongheon Park, Whasung-Si (KR); Yoonho Cho, Whasung-Si (KR); Il Joong Hwang, Whasung-Si (KR); Dong Hoon Seok, Whasung-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 10 days.

(21) Appl. No.: 14/145,473

(22) Filed: Dec. 31, 2013

(65) Prior Publication Data

US 2015/0068476 A1 Mar. 12, 2015

(30) Foreign Application Priority Data

Sep. 6, 2013 (KR) ..... 10-2013-0107414

(51) Int. Cl.
*F01L 1/34* (2006.01)
*F01L 1/344* (2006.01)

(52) U.S. Cl.
CPC ..... *F01L 1/34* (2013.01); *F01L 2001/34433* (2013.01)

(58) Field of Classification Search
CPC ..... F01L 1/34; F01L 2001/34433
USPC ..... 123/90.15, 90.17, 90.38
See application file for complete search history.

(56) References Cited

U.S. PATENT DOCUMENTS 7,389,756 B2 * 6/2008 Hoppe et al. ..... 123/90.17
7,685,981 B2 * 3/2010 Matsushima et al. ..... 123/90.17

FOREIGN PATENT DOCUMENTS

JP 2012-67699 A 4/2012
KR 10-0521221 B1 10/2005
KR 10-2006-0023334 A 3/2006
KR 10-2011-0059594 A 6/2011
KR 10-1090799 B1 12/2011

OTHER PUBLICATIONS

Shinobu Shimasaki, Oil Control Valve and Hydraulic Control Apparatus, US Patent Application Publication, Pub. No. US 2012/0048410, Mar. 1, 2012.*

* cited by examiner

*Primary Examiner* — Ching Chang
(74) *Attorney, Agent, or Firm* — Morgan, Lewis & Bockius LLP

(57) ABSTRACT

An engine having a variable valve timing mechanism may include a camshaft having a cam formed thereon for moving an intake or exhaust valve, a variable rotation unit disposed on the same axis with the camshaft to rotate the camshaft to have a retard angle chamber and an advance angle chamber for controlling a retard angle and an advance angle of the camshaft, a variable valve bolt having a fastening portion for fastening the variable rotation unit to the camshaft, and an oil control valve for making selective supply of hydraulic oil to the retard angle chamber and the advance angle chamber, and a valve controller disposed on an outer side of the variable rotation unit for controlling the oil control valve in the variable valve bolt.

7 Claims, 3 Drawing Sheets

ENGINE HAVING CONTINUOUSLY VARIABLE VALVE TIMING MECHANISM

CROSS-REFERENCE TO RELATED APPLICATION

The present application claims priority to Korean Patent Application No. 10-2013-0107414 filed on Sep. 6, 2013, the entire contents of which is incorporated herein for all purposes by this reference.

BACKGROUND OF THE INVENTION

1. Field of the Invention

The present invention relates to an engine having a continuously variable valve timing mechanism which makes a camshaft which moves an intake or exhaust valve to retard or advance for minimizing a compression loss in a combustion chamber and reducing fuel consumption.

2. Description of Related Art

In order to improve an engine performance, reduce the fuel consumption, and improve a quality of exhaust gas, the continuously variable valve timing (CVVT) mechanism has been introduced for making a rotation phase of the camshaft to advance or retard.

FIG. 1 illustrates a schematic diagram of an engine having a related art continuously variable valve timing mechanism. Referring to FIG. 1, the engine is provided with a cylinder head 140, a camshaft 100, a variable rotation unit 110, an oil control valve (OCV) 130, and a variable valve bolt 120, wherein an advance flow circuit 122 and a retard flow circuit 124 are formed in one side of the camshaft 100.

The variable rotation unit 110 is a pulley or sprocket fixedly secured to an end of the camshaft 100 with the variable valve bolt 120.

The variable rotation unit 110 is rotated by the engine through a crankshaft and a chain or belt to rotate the camshaft 100.

And, the variable rotation unit 110 has a retard angle chamber formed therein connected to the retard flow circuit 124, and an advance angle chamber formed therein connected to the advance angle circuit 122.

When the oil control valve 130 supplies hydraulic oil to the retard angle chamber, making the variable rotation unit 110 to rotate forward relatively, the camshaft 100 is retarded, and, when the oil control valve 130 supplies hydraulic oil to the advance angle chamber, making the variable rotation unit 110 to rotate backward relatively, the camshaft 100 is advanced.

In the meantime, in order to control the oil to be supplied to the variable rotation unit 110, the OCV (oil control valve) 130 is required, as well as a solenoid valve which is an additional control element for controlling the oil control valve 130.

Along with this, a space for mounting the oil control valve 130 and the solenoid valve is required, and a flow circuit for controlling a hydraulic pressure is liable to be lengthy and complicate.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine having a continuously variable valve timing mechanism having advantages of minimizing a compression loss in a combustion chamber and reducing fuel consumption. According to an exemplary embodiment of the present invention, an object of the present invention is to provide an engine having the variable valve timing mechanism which can reduce spaces required for mounting an oil control valve and a solenoid valve, simplify a flow circuit required for hydraulic control, and reduce a length of the flow circuit.

In an aspect of the present invention, an engine having a variable valve timing mechanism may include a camshaft having a cam formed thereon for moving an intake or exhaust valve, a variable rotation unit being coaxially disposed with the camshaft to rotate the camshaft and having a retard angle chamber and an advance angle chamber for controlling a retard angle and an advance angle of the camshaft, a variable valve bolt having a fastening portion for fastening the variable rotation unit to the camshaft, and an oil control valve for making selective supply of hydraulic oil to the retard angle chamber and the advance angle chamber, and a valve controller disposed on an outer side of the variable rotation unit for controlling the oil control valve in the variable valve bolt.

The variable valve bolt is passed through a center portion of the variable rotation unit and a center portion of the camshaft to fasten the variable rotation unit to the camshaft with a thread structure.

The valve controller is a solenoid valve.

The valve controller is coaxially disposed with the camshaft matched to a rotation axis of the variable rotation unit.

The variable rotation unit may have a torque forwarded thereto from the engine through a belt or a chain to control the camshaft at a preset retard angle phase, intermediate angle phase, or advance angle phase.

The valve controller is attached to an outer side of a cover which covers the belt or chain.

The valve controller is mounted to one side of a head cover which covers the camshaft.

To achieve the object of the present invention, an engine having a variable valve timing mechanism can reduce an overall mounting space, simplify hydraulic control circuits, and reduce a length of the circuits by forming the oil control valve in the variable valve bolt, and mounting the solenoid valve to an outer side of the variable rotation unit.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
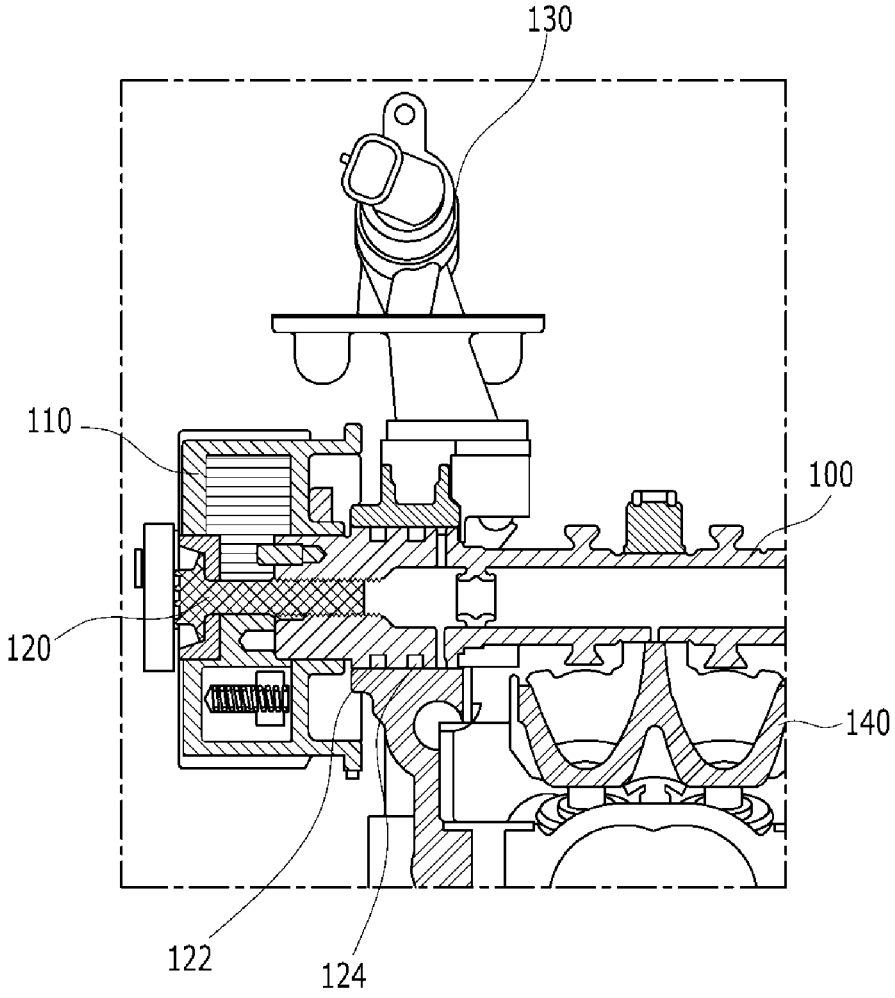
FIG. 1 (Related Art)
FIG. 1 illustrates a schematic diagram of an engine having a related art continuously variable valve timing mechanism.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

An engine to which the present invention is applicable is a gasoline or diesel internal combustion engine to which MPI (Multi Point Injection), GDI(Gasoline Direct Injection), TGDI(Turbo Gasoline Direct Injection), CDA(Cylinder Deactivation), or TGDI(Turbo Gasoline Direct Injection)+ CDA(Cylinder Deactivation) may be applicable.

And, the engine has a retard angle/an advance angle of an intake cam controlled optimally according to engine RPM and load, and the Atkinson cycle implemented thereto to reduce a pumping loss and increase a net compression ratio owing to an LIVC (Late Intake Valve Closing) effect, thereby reducing fuel consumption and THC (Total Hydro Carbon).

Along with this, the engine has the retard angle/the advance angle controlled faster than a related art DCVVT (double continuously variable valve timing), and an improved responsiveness, reduced oil and fuel consumption, and an improved quality of exhaust gas compared to the related art DCVVT.

Therefore, in order to improve an initial starting performance and change an operation timing of an intake cam, the continuously variable valve timing (CVVT) mechanism having a mechanical locking mechanism is applied to an intake side, and the continuously variable valve timing (CVVT) mechanism having a unitary oil control valve (OCV) is applied to an exhaust side.

And, by embodying structure and function of the oil control valve within a variable valve bolt, a length of a total flow circuit is reduced, enabling to reduce an oil supply time period. Along with this, by applying a check valve to the flow circuit which is used for controlling the CVVT, the responsiveness may be improved, wherein a position of the check valve may be the variable rotation unit, in the oil control valve, in the cylinder head, or in the camshaft.

An intermediate phase locking continuously variable valve timing (CVVT) mechanism starts at an intermediate position, and is retarded or advanced according to an engine operation state. And, by using a locking technology, the intermediate phase locking continuously variable valve timing (CVVT) mechanism makes the phase of an intake side valve to be changed to an intermediate phase when the engine stops.

And, in view of structure, by disposing the solenoid valve and the oil control valve on the same axis with the camshaft, forming the oil control valve and the flow circuit in the variable valve bolt, and by shortening the length of the flow circuit and using the check valve, the responsiveness is improved, and by mounting the solenoid valve to a head cover or a chain cover, a mounting space may be reduced.

Herein, a structure of the continuously variable valve timing (CVVT) mechanism having the unitary oil control valve will be described in detail, with reference to FIG. 2.

Figure 2:
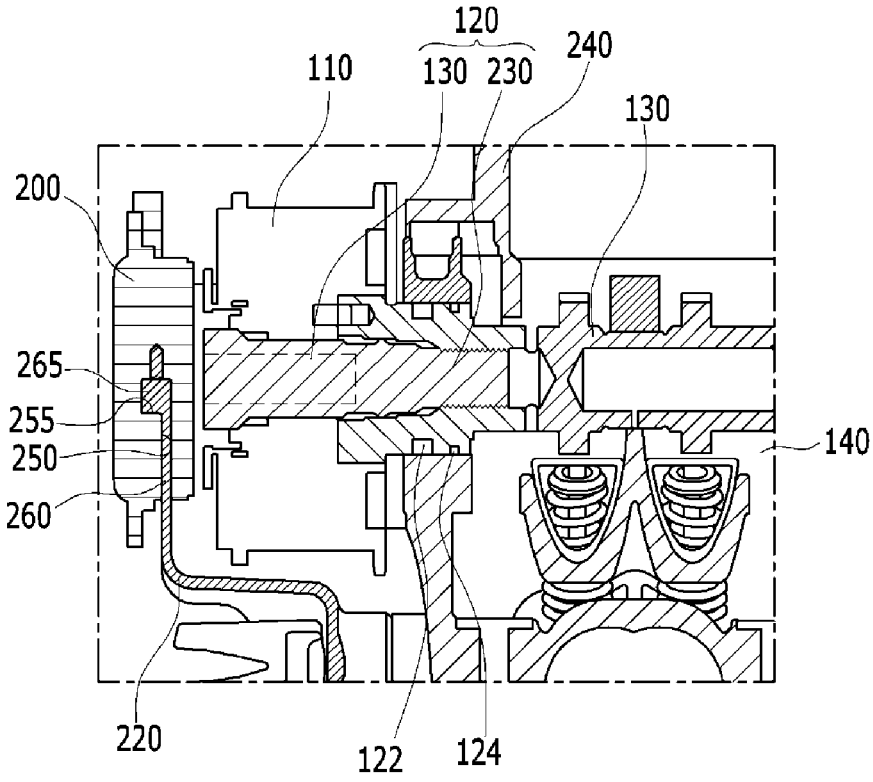
FIG. 2 illustrates a partial sectional view of an engine having a continuously variable valve timing mechanism in accordance with an exemplary embodiment of the present invention.

FIG. 2 illustrates a partial sectional view of an engine having a continuously variable valve timing mechanism in accordance with an exemplary embodiment of the present invention.

Referring to FIG. 2, the continuously variable valve timing mechanism includes a cylinder head 140, a valve controller 200, a variable rotation unit 110, a variable valve bolt 120, a camshaft 100, a chain cover 220, and a head cover 240.

The variable valve bolt 120 includes the oil control valve (OCV) 130 disposed on the same axis with the camshaft 100, and a fastening portion 230 which is fastened to the camshaft 100 with a thread structure.

The camshaft 100 is disposed on the cylinder head 140 to open/close intake/exhaust valves of the cylinder, and the variable rotation unit 110 is mounted to one end portion of the camshaft 100.

The valve controller 200 is mounted to an outer side of the variable rotation unit 110 disposed on the same axis with the variable valve bolt 120 and the camshaft 100.

And, the valve controller 200 may be fixedly secured to the chain cover which covers the variable rotation unit 110, or may be mounted to the head cover 240 which covers an upper side of the camshaft 100.

The variable rotation unit 110, a pulley or a sprocket rotated by the crank shaft of the engine through a belt of a chain, has the retard angle chamber and the advance angle chamber formed therein, and an intermediate phase locking unit, such as a locking pin.

In an exemplary embodiment of the present invention, since an inside structure of the variable rotation unit 110 having the retard angle chamber, the advance angle chamber and the intermediate phase locking unit is known, detailed description of which will be omitted.

The camshaft 100 has the advance circuit and the retard circuit formed therein, and, in the variable valve bolt 120, the oil control valve 130 is controlled by the valve controller 200 that is the solenoid valve to open/close a flow circuit connected to the retard angle chamber, the advance angle chamber, or the intermediate phase locking unit.

Figure 3:
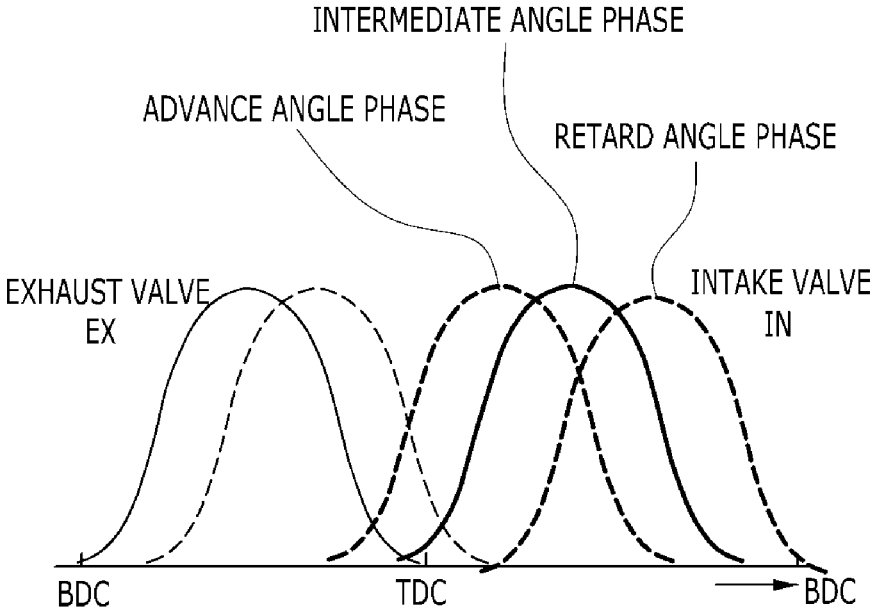
FIG. 3 illustrates a graph showing valve lift phases of a continuously variable valve timing mechanism in accordance with an exemplary embodiment of the present invention.

FIG. 3 illustrates a graph showing valve lift phases of a continuously variable valve timing mechanism in accordance with an exemplary embodiment of the present invention.

Referring to FIG. 3, a horizontal axis denotes a rotation angle of the crankshaft, and a vertical axis denotes an amount of lift of the exhaust valve or the intake valve.

As shown, the exhaust valve is retarded at an initial position according to a rotation speed of the engine and an engine load, and the intake valve is advanced or retarded at an initial intermediate position according to the rotation speed of the engine and the engine load.

As described above, since the intake valve is closed in retard, a compression stroke is shortened, and a pressure in the intake manifold is increased, to reduce a pumping loss and elevation of a pressure in the compression stroke. Eventually, total fuel consumption is reduced, and a quality of the exhaust gas is improved.

The valve controller 200 is mounted to chain cover 220 covering an outer side of a chain through which an engine torque is forwarded, wherein an insertion portion 260 extending upwards is formed at the chain cover 220, and an extending portion 265 extending in an outer or an inner side of an axial direction of the camshaft 100 is formed at an upper end portion of the insertion portion 260, wherein an insertion groove 250 into which the insertion portion 260 is inserted, is formed in the valve controller 200, and a locking groove 255 corresponding to the extending portion 265 is formed in an upper portion of the insertion groove 250, and wherein the extended portion 265 is disposed on a position corresponding to the axial direction of the camshaft 100. Therefore, the valve controller 200 can be fixed more firmly to the chain cover 220, and an assembly position of the valve controller 200 can be more easily set up by the position of the extended portion 265.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. An engine having a variable valve timing mechanism comprising:

a camshaft having a cam formed thereon for moving an intake or exhaust valve;

a variable rotation unit being coaxially disposed with the camshaft to rotate the camshaft and having a retard angle chamber and an advance angle chamber for controlling a retard angle and an advance angle of the camshaft;

a variable valve bolt having:

a fastening portion for fastening the variable rotation unit to the camshaft; and an oil control valve for making selective supply of hydraulic oil to the retard angle chamber and the advance angle chamber; and a valve controller disposed on an outer side of the variable rotation unit for controlling the oil control valve in the variable valve bolt, wherein the valve controller is attached to an outer side of a cover which covers a belt or a chain.

2. The engine having the variable valve timing mechanism of claim 1, wherein the variable valve bolt is passed through a center portion of the variable rotation unit and a center portion of the camshaft to fasten the variable rotation unit to the camshaft with a thread structure.

3. The engine having the variable valve timing mechanism of claim 1, wherein the valve controller is a solenoid valve.

4. The engine having the variable valve timing mechanism of claim 1, wherein the valve controller is coaxially disposed with the camshaft matched to a rotation axis of the variable rotation unit.

5. The engine having the variable valve timing mechanism of claim 1, wherein the variable rotation unit has a torque forwarded thereto from the engine through a belt or a chain to control the camshaft at a preset retard angle phase, intermediate angle phase, or advance angle phase.

6. The engine having the variable valve timing mechanism of claim 1, wherein the valve controller is mounted to one side of a head cover which covers the camshaft.

7. The engine having the variable valve timing mechanism of claim 1, wherein the cover includes:

an insertion portion extending upwards, wherein the insertion portion is mounted in an insertion groove formed in the valve controller, and an extending portion formed at an upper end portion of the insertion portion and extending in an outer or an inner side of an axial direction of the camshaft, wherein the extending portion is mounted in a locking groove formed in an upper portion of the insertion groove in the valve controller, wherein the extending portion is disposed on a position corresponding to an axial direction of the camshaft.

* * * * *